United States Patent [19]

Levasseur

[11] 3,963,035

[45] June 15, 1976

[54] COIN CONTROLLED CIRCUITS FOR VENDING AND OTHER COIN CONTROLLED DEVICES

[75] Inventor: Joseph L. Levasseur, St. Louis, Mo.

[73] Assignee: H. R. Electronics Company, High Ridge, Mo.

[22] Filed: Oct. 7, 1974

[21] Appl. No.: 512,850

Related U.S. Application Data

[63] Continuation-in-part of Ser. No. 381,900, July 23, 1973, Pat. No. 3,841,456.

[52] U.S. Cl. ..... 133/2; 194/1 N

[51] Int. Cl.[2] ..... G07D 1/06

[58] Field of Search ..... 133/2, 4; 194/1 N, 9 R, 194/10; 221/14, 17

[56] References Cited

UNITED STATES PATENTS

| | | | |
|---|---|---|---|
| 3,131,702 | 5/1964 | Buchholz et al. | 133/2 X |
| 3,250,363 | 5/1966 | Hooker | 194/10 |
| 3,368,570 | 2/1968 | Nagy et al. | 133/2 |
| 3,461,887 | 8/1969 | Englund et al. | 133/2 |
| 3,754,629 | 8/1973 | Douglass | 194/1 N |
| 3,756,256 | 9/1973 | Hatanaka et al. | 133/4 |

*Primary Examiner*—Stanley H. Tollberg
*Assistant Examiner*—Joseph J. Rolla
*Attorney, Agent, or Firm*—Charles B. Haverstock

[57] ABSTRACT

A control circuit for vending and other coin controlled devices which have arrangements to payback amounts deposited in excess of the vend price, the vending machine having a plurality of coin tubes for respectively containing coins of different denominations for payback, each tube having a sensor associated therewith to produce a response whenever the quantity of coins contained therein has fallen below a predetermined quantity insufficient to be used for payback, the improvements comprising a control circuit for controlling the operation of the coin tubes during payback and escrow operations of amounts deposited incuding circuit elements for controlling the making of paybacks and escrowing in the highest possible denominations of coins, said circuit elements responsive to responses produced by the sensor on the respective coin tubes including apparatus for shifting a payout operation from paying back of higher denomination coins to paying back of lower denomination coins whenever the quantity of coins in the higher denomination coin tubes has fallen below said predetermined quantity.

6 Claims, 2 Drawing Figures

COIN CONTROLLED CIRCUITS FOR VENDING AND OTHER COIN CONTROLLED DEVICES

This application is a Continuation-In-Part of Levasseur U.S. Pat. application Ser. No. 381,900, filed July 23, 1973, now U.S. Pat. No. 3,841,456, The present invention relates to means to control the paying out of amounts deposited in excess of a selected vend or as an escrow or refund using the least possible number of coins available to achieve the payout. The improvement is particularly adaptable to payout units which include a plurality of coin tubes for storing different denomination coins used in the payout and resides in means associated with the different denomination coin tubes which respond to a condition in the tube when the coinage accumulated therein falls below a predetermined amount. When this occurs in the highest denomination coin tube, circuit means will be energized to cause payouts to be made from the coin tube for the next higher coin denomination, and when coins of the next higher denomination are also exhausted for payout purposes, payouts will be made from the next lower denomination coin tube and so forth until finally the payout will be in the lowest denomination coins. The circuit means for accomplishing this are at the heart of the invention. No similar means are included in any known vending control circuit.

It is therefore a principal object of the present invention to provide improved and more versatile means for controlling the paying out of coins from a vending or other similar machine.

Another object is to provide means for paying out or refunding in the least possible number of coins taking into account coin availability in the different denominations.

Another object is to shift from paying back coins of one denomination to paying back coins of lesser denominations when the coins of the higher denominations become exhausted in a coin storage for payback device.

Another object is to further reduce the chances for a customer losing money deposited in a vending machine.

Another object is to provide greater flexibility and versatility in the refunding or paying back of amounts deposited including amounts deposited in excess of a vend price as well as total amounts deposited as in escrowing.

Another object is to provide a gate control means operable in conjunction with the coin payout means on a vending or other similar device to control the denomination of coins paid back to a customer.

Figure 1:
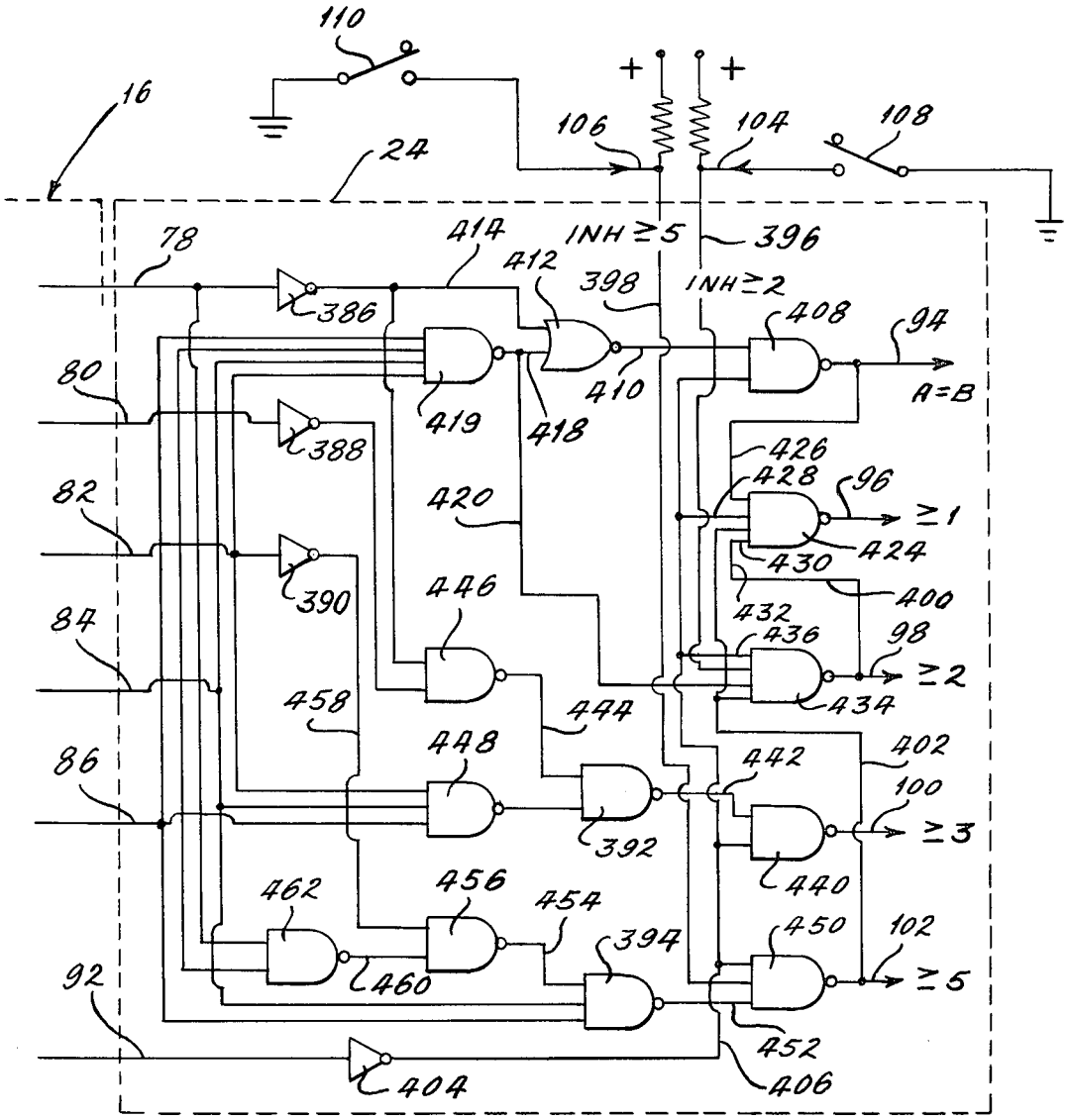
Figure 2:
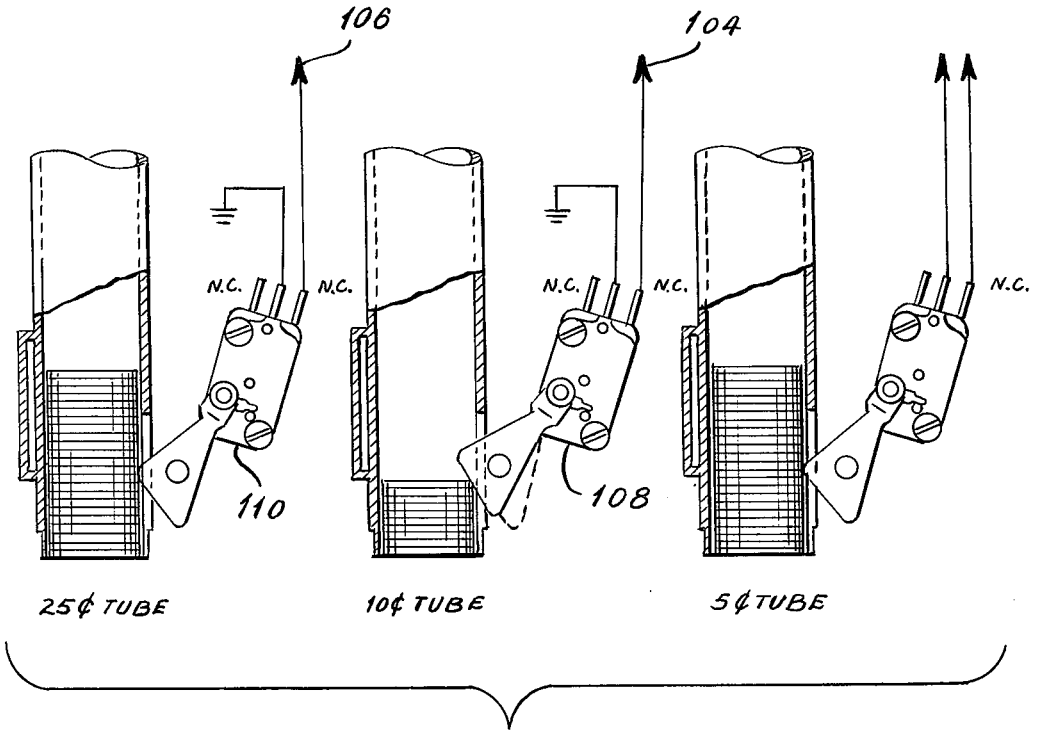

These and other objects and advantages of the present invention will become apparent after considering the following detailed specification which covers a preferred embodiment of the subject device in conjunction with the accompanying drawings, wherein:

FIG. 1 is a schematic circuit diagram of a control cricuit for use with the coin refund means of a vending or like machine; and, FIG. 2 is a cross-sectional view showing nickel, dime and quarter coin tubes and their associated empty tube switches.

Referring to the drawing more particularly by reference numbers, number 24 refers to an output decoder circuit similar to the output decoder circuit 24 shown in FIG. 3 of the drawings in copending Levasseur U.S. Pat. application Ser. No. 381,900, now U.S. Pat. No. 3,841,456. Other circuits in the parent case which are operated in conjunction with the decoder circuit 24 are fully and completely described therein and some of these can be used with the present circuit if desired and they will not be again described in detail herein. The present means can also be used with other types of vending control circuits including those disclosed in Levasseur U.S. Pat. No. 3,841,456, Douglass U.S. Pat. No. 3,754,629, dated Aug. 23, 1973 and Johnson II U.S. Pat. No. 3,687,255, dated Aug. 29, 1972, all of which are assigned to Applicant's assignee.

The decoder circuit 24 as disclosed herein is in the output of the comparator circuit 16 and produces outputs which control certain other operations and circuit functions and devices including certain other devices on the vending machine. The decoder circuit 24 has a plurality of input connections some of which are connected to the output leads 78-86 of the comparator circuit 16, and the decoder has an input connection to the carry output lead 92 from the comparator circuit. The decoder also has a plurality of outputs at 94, 96, 98, 100 and 102. These outputs go to low conditions when they are active. The output 94 goes to a low condition whenever the A counter 14 has an amount accumulated therein that exactly equals the amount that is accumulated in the B counter 20. This is illustrated in the drawing by the expression A = B adjacent to the lead 94. In a similar manner, the voltage on the encoder output 96 goes low whenever the amount accumulated in the counter 14 is one or more increments greater than the amount accumulated in the counter 20, the voltage on the output 98 goes low whenever the amount entered in the counter 14 is two or more increments greater than the amount in the counter 20; the voltage on the output 100 goes low whenever the amount entered in the counter 14 is three or more increments greater than the amount in the counter 20; and the voltage on the output 102 goes low whenever the counter 14 has in it five or more increments more than are entered in the counter 20. Only one of the encoder outputs leads 94, 96, 98, 100 or 102 can be at a low condition at any one time, and the highest detected incremental difference between the amounts entered in the counters will prevail. That is, if the condition exists for an output on the lead 102 to be low, this will prevail and take precedence over possible lows which may also exist on the other three outputs 96, 98 and 100, and so forth.

The encoder circuit 24 as shown has two other inhibit input connections, one being an inhibit input identified as ≥ 2 inhibit which appears on lead 104 and the other is identified as ≥ 5 inhibit which appears on lead 106. When either of the leads 104 or 106 is at a low state due to closure of an empty coin tube switch 108 or 110, they operate to prevent the encoder output leads 98 and 102 from being operative. These same conditions enable the next highest incremental difference encoder output (outputs 96 and 98 respectively) to assume control. In the circuit as shown, the encoder output lead 100, which is the ≥ 3 output is not used because it is not needed in a nickel, dime, quarter system and therefore is not connected. This is because the circuit as shown is wired primarily to accommodate a monetary system such as that used in the United States where one increment represents a nickel, two increments represents a dime, and five increments represents a quarter. In monetary systems where different combinations of increment values are used it may be necessary to use the ≥ 3 output lead 100, and to also provide another associated inhibit input connection. In such a case, it may also be necessary to provide an additional coin switch corresponding to the different value coins. The present circuit could also be made to accommodate more coin denominations including pennies and half dollars, for example.

The decoder circuit 24 as shown is included to provide the complement of the sum of the outputs of the counters 14 and 20, and this is accomplished in the decoder circuit by means of inverters 386, 388 and 390 and NAND gates 392 and 394 which are connected as shown. The outputs of the decoder circuit 24 are present on the output leads 94, 96, 98, 100 and 102 as aforesaid and these outputs indicate various relationships that can exist between the values accumulated in the A and B counters 14 and 20, and are indicated as stated by the presence of a low on the respective output leads. For example, when the amount accumulated in the A counter 14 (representing an amount desposited) is equal to the amount accumulated in the B counter 20 (representing the vend price) the output on the decoder output lead 94 will be low, and the outputs on the other decoder output leads will be high. In similar manner, when the counter 14 has accumulated in it a larger amount than is accumulated in the B counter 20, the output on the output lead 96 will be low. When the amount in the A counter 14 is larger than the amount in the B counter by two, three and four increments, then the output on output lead 98 will be low. When a coin tube switch such as the dime coin tube switch 108 is closed indicating the tube is empty or is below some predetermined quantity of coins producing a low condition on the lead 104, which lead is connected to lead 396, it will operate to inhibit the output on the lead 98. When the counter 14 has three or more increments more than the counter 20, the output 100 will go low to indicate the condition. This condition, while available, is not used in the circuit as shown, but could be if the circuit were adapted to other coinage systems. When the A counter 14 has five or more increments more than the B counter 20, the output on the lead 102 goes low unless at this time the quarter empty tube switch 110 is activated and closed putting a low on connected leads 106 and 398 and on the input to the gate 450 associated with the ≥ 5 lead 102.

The decoder circuit 24 has other connections which operate to prevent certain outputs from occurring. For example, when the output lead 98 is low it prevents the lead 96 from going low. This is accomplished in the circuit by lead 400 which couples the output of the gate 434 associated with the lead 98 to the input to the gate 424 associated with the lead 96. In like manner, whenever the output on the lead 102 goes low it will prevent outputs on the leads 96 and 98 from going low by signals on lead 402 which is connected between the output of the gate 450 associated with the output lead 102 and inputs to the gates 434 and 424 associated with the outputs 98 and 96. Consequently, if the inhibit ≥ 5 lead 398 is low, the ≥ 2 output on the lead 98 will go low for any count present in the A counter 14 that is two or more greater than the amount accumulated in the B counter 20 including conditions where the difference is five or more increments. Similarly if both the inhibit input leads 396 and 398 are low at the same time indicating a deficiency of both dimes and quarters for payout, then the ≥ 1 output lead 96 will go low for any count in the A counter 14 that is one or more greater than the amount in the B counter 20. This means that whenever a five increment coin such as a quarter is not available for refund or escrow, the circuit as shown, will indicate that a two increment coin such as a dime should be refunded instead, and if dimes are likewise not available then the circuit will indicate that refunds are to be made in one increment coins only, namely, in nickels. It should be apparent that the present circuit can also be used with any known coinage system regardless of the relative increment values of the coins involved, although some minor changes in the connections may be required.

The decoder circuit 24 has another inverter 404 which is connected between the carry-out output lead 92 of the comparator circuit 16 and the various output gates of the decoder circuit 24. The inverter 404 provides a low condition on lead 406 to prevent any flase outputs from being produced by the decoder 24 when the A counter 14 has an amount accumulated therein that is less than the amount accumulated in the B counter 20. The outputs on the lead 406 are applied to the inputs of a plurality of decoder output gates including NAND gate 408 which is the gate that produces the outputs on the lead 94 to indicate a condition of equality between the amounts accumulated in the counters 14 and 20. The other controls in the circuit which establish different output conditions of equality and the ≥ 1, ≥ 2, ≥ 3, and ≥ 5 are described in detail in U.S. Pat. No. 3,841,456 and it is not deemed necessary to repeat the description since it is not part of the present invention as such.

FIG. 2 shows a typical set of coin tubes from which paybacks or escrow is made from a vending machine. In FIG. 2 three coin tubes are shown to illustrate their construction including a nickel, a dime and a quarter coin tube. Each of the coin tubes has its own associated empty coin tube switch, the empty coin tube switch for the dime coin tube being identified by number 108 and the empty coin tube switch for the quarter coin tube being identified by number 110. These coin tube switches are connected respectively to the leads 104 and 106 as shown in the circuit of FIG. 1. It is not deemed necessary to describe the operation of the coin tubes and their associated empty tube switches and actuator means in detail since these may be of conventional construction.

The subject control circuit provides a large measure of flexiblity and selectivity in its construction and operation, and lends itself to use under a variety of different operating circumstances including a variety of different vend price possibilites, coin denomination possibilities, and a variety of selectivity with respect to the outputs produced. These possibilites manifest themselves in the circuit as disclosed by providing control over the payout control means, the escrow control means and the other circuits and circuit elements associated therewith.

Thus there has been shown and described a novel and extremely versatile vending control circuit which fulfills all of the objects and advantages sought therefor. It is apparent, however, as indicated, that many changes, modifications, variations, and other uses and applications of the subject control are possible and will become apparent to those skilled in the art after considering this specification which describes a preferred embodiment only. All such changes, modifications, variations and other uses and applications which do not depart from the spirit and scope of the invention are deemed to be covered by the invention which is limited only by the claims which follow.

What is claimed is:

1. In a coin controlled device having means to accumulate amounts deposited and means to pay back amounts deposited in excess of a vend price including a plurality of coin tubes for respectively accumulating different denomination coins, each of said coin tubes having coin sensing means associated therewith to produce a response whenever the quantity of coins therein has fallen below a predetermined quantity, coin tube actuator means associated with each coin tube and means for energizing the respective coin tube actuator means to pay back coins therefrom, the improvement comprising gate circuit means associated with each coin tube, each of said gate circuit means having an output connected to energize the associated actuator means, means connecting the output of the gate circuit associated with a higher denomination coin tube to an input to gate circuit means associated with a lower denomination coin tube, circuit means for determining the highest denomination coin that can be paid back, means including the sensing means associated with a higher denomination coin tube to inhibit energizing of the actuator means associated therewith and prevent paying back coins therefrom whenever a response is produced by the coin sensing means associated therewith, said last named means including circuit means to establish a circuit to enable energizing of the actuator means associated with a lower denomination coin tube that contains more than the predetermined quantity of coins therein to make further paybacks therefrom.

2. In the coin controlled device defined in claim 1 said coin sensing means associated with each coin tube to produce a response when the coins therein fall below the predetermined quantity include coin tube switch means and a source of energy associated therewith.

3. In the coin controlled device defined in claim 1 the different denomination coin tubes include coin tubes for nickels, dimes and quaters.

4. In a coin controlled device having means to payback amounts deposited in access of a vend price and to make coin refunds, the means including a plurality of coin tubes for containing coins of different respective denominations to be paid back, the improvement comprising means associated with each of the coin tubes to produce an output response whenever the quantity of coins contained therein falls below a preestablished quantity, actuator means associated respectively with each of the coin tubes and energizable to cause the respective coin tubes to payback coins therefrom, means associated with each of said coin tubes responsive to each output response produced when the quantity of coins contained therein falls below said preestablished quantity, said last named means including means to inhibit energizing of the associated actuator means, means for selectively energizing the respective coin tube actuator means including a gate circuit having a gate associated with each of said coin tube actuator means, each of said gates having input and output connections, means connecting an output of the gate associated with a higher denomination coin tube to an input of a gate associated with a lower denomination coin tube, said connection establishing circuit means to energize the actuator means associated with the lower denomination coin tube whenever the gate circuit associated with the higher denomination coin tube is inhibited from operating because the quantity of coins therein is below said preestablished quantity.

5. In a coin control device having means to accumulate amounts deposited and means to payback amounts deposited in excess of a vend price including a plurality of coin tubes for respectively accumulating different denomination coins including coin tubes for nickels, dimes and quarters, each of said coin tubes having coin sensing means associated therewith to produce a response whenever the quantity of coins therein has fallen below a predetermined quantity, coin tube actuator means associated with each coin tube and means for energizing the respective coin tube actuator means to payback coins therefrom, the improvement comprising circuit means associated with a higher denomination coin tube to inhibit energizing of the actuator means associated therewith and prevent paying back coins therefrom whenever a response is produced by the coin sensing means associated therewith, said last named means including circuit means to causing energizing of the actuator means associated with a lower denomination coin tube to make further paybacks therefrom, a first gate circuit associated with the quarter coin tube, said first gate circuit producing an output to energize the quarter tube actuator means wherever an amount to be paid back at least equals a quarter, means to inhibit energizing of the quarter tube actuator means whenever a response is produced by the means associated with the quarter coin tube that indicate the quantity of coins therein has fallen below said predetermined quantity, and a second gate circuit associated with the dime coin tube, said second gate circuit having an input connected to the output of the first gate circuit for producing an output to energize the actuator means associated with the dime coin tube to pay back dimes whenever the quarter coin tube is inhibited at a time when an amount to be paid back at least equals a quarter.

6. In the coin controlled device of claim 5 a third gate circuit is associated with the nickel coin tube, said third gate circuit having an input connected to the output of the second gate circuit for producing an output to energize the actuator means associated with the nickel coin tube to pay back nickels whenever the dime coin tube is inhibited at a time when an amount to be paid back at least equals a dime.

* * * * *